US007028786B2

(12) United States Patent
Kuhnle et al.

(10) Patent No.: US 7,028,786 B2
(45) Date of Patent: Apr. 18, 2006

(54) HAND MACHINE TOOL

(75) Inventors: Axel Kuhnle, Freiberg A. N. (DE); Helmut Wanek, Bietigheim-Bissingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/432,074

(22) PCT Filed: Jun. 26, 2002

(86) PCT No.: PCT/DE02/02323

§ 371 (c)(1),
(2), (4) Date: May 19, 2003

(87) PCT Pub. No.: WO03/037571

PCT Pub. Date: May 8, 2003

(65) Prior Publication Data

US 2004/0011541 A1 Jan. 22, 2004

(30) Foreign Application Priority Data

Oct. 26, 2001 (DE) ..... 101 52 959

(51) Int. Cl.
*B25D 11/00* (2006.01)

(52) U.S. Cl. ..... 173/131; 173/216; 173/128

(58) Field of Classification Search ..... 173/216, 173/131, 128; 279/138, 141, 154
See application file for complete search history.

(56) References Cited

U.S. PATENT DOCUMENTS

| | | | | |
|---|---|---|---|---|
| 4,236,588 | A | 12/1980 | Moeldan et al. | |
| 5,199,833 | A * | 4/1993 | Fehrle et al. | 408/239 R |
| 5,437,465 | A | 8/1995 | Vogele et al. | |
| 5,603,516 | A | 2/1997 | Neumaier | |
| 6,073,705 | A | 6/2000 | Shibata et al. | |
| 6,527,280 | B1 * | 3/2003 | Frauhammer et al. | 279/19.5 |
| 6,688,611 | B1 * | 2/2004 | Gifford et al. | 279/71 |
| 2001/0008186 | A1 | 7/2001 | Franhammer et al. | |
| 2001/0013683 | A1 | 8/2001 | Yahagi | |

FOREIGN PATENT DOCUMENTS

| | | |
|---|---|---|
| DE | 38 28 309 | 2/1990 |
| DE | 44 19 826 | 12/1995 |
| EP | 0 456 003 | 11/1991 |
| GB | 2 297 513 | 8/1996 |
| GB | 2297513 A * | 8/1996 |
| GB | 2 313 566 | 12/1997 |

* cited by examiner

*Primary Examiner*—Scott A. Smith
*Assistant Examiner*—Brian Nash
(74) *Attorney, Agent, or Firm*—Michael J. Striker

(57) ABSTRACT

A hand power tool has a housing (10), a hammer barrel (12), a tool receptacle (14) that is separated from the hammer barrel (12) at least one locking body (16) for fixing the tool receptacle (14) in a direction of rotation (18), a transmission unit (20) arranged radially outwardly of the tool receptacle (14) for transmitting a torque from the tool receptacle (14) radially outwardly and fixing the tool receptacle (14) in the direction of rotation (18) of the tool receptacle (14) on the housing (10), one part of the transmission unit (20) being formed by an actuating sleeve (28), the transmission unit (20) having a claw ring (30) which is separate from the actuating sleeve (28) and the tool receptacle (14) being connected through the claw ring (30) with the actuating sleeve (28) in the direction of rotation (18).

9 Claims, 4 Drawing Sheets

HAND MACHINE TOOL

This application is a 371 of PCT/DE02/02323, filed June 26, 2002.

BACKGROUND OF THE INVENTION

The invention is based on a hand power tool.

From German Patent Disclosure DE 195 03 525 A1, a hand power tool of this generic type is known, specifically a percussion hammer, in whose housing a hammer barrel, with a tool receptacle separate from it, is disposed. A plurality of locking recesses are distributed over the circumference of the hammer barrel, on a side toward the tool receptacle, and locking bodies retained in openings in the tool receptacle can selectively engage these locking recesses. The tool receptacle radially surrounds the hammer barrel in an overlapping region and can be fixed radially inward in the direction of rotation via the locking bodies and the hammer barrel. The locking bodies are held in the engagement position by a locking sleeve that radially surrounds the tool receptacle. The locking sleeve is supported rotatably relative to the tool mount and has radial pockets for unlocking the tool mount.

SUMMARY OF THE INVENTION

The invention is based on a hand power tool, in particular a percussion hammer, having a housing, a hammer barrel, and a tool receptacle that is fixable in the direction of rotation via at least one locking body.

It is proposed that the tool receptacle is fixable radially outward on the housing in the direction of rotation via at least one transmission unit. A hand power tool is attainable in which the components of the transmission unit, in particular wearing parts, can be replaced especially simply. Complete disassembly of the hand power tool can advantageously be avoided, and expenses, especially for repair, can be reduced.

If the tool receptacle is fixable in at least two rotary positions, then a tool secured in the tool receptacle, especially a forming tool, can advantageously be changed in its position. Ease of use can be enhanced, and for a user, the work can be made more pleasant.

If the transmission unit is braced in the direction of rotation via at least one set of teeth on the housing, then existing components can be used advantageously, thus economically dispensing with additional components. Less Installation space is needed, and both weight and the effort and expense of assembly can be reduced.

Moreover, economies in terms of components, installation space, weight and assembly effort can be achieved if one part of the transmission unit is formed by an actuating sleeve.

Advantageously, the set of teeth, by way of which the tool receptacle is fixable on the housing with the corresponding set of teeth, is formed onto the actuating sleeve. A device with only a few additional components can be attained, in which forces that can be transmitted to the housing via the actuating sleeve can be distributed over a large transmission area. The load on the components can advantageously be lessened, and wear of the components can be reduced.

It is also proposed that the tool receptacle is connected to the actuating sleeve via a claw ring of the transmission unit. With the claw ring, a large total transmission area, low pressure per unit of surface area, little wear, and a long service life of the components can be attained structurally simply and inexpensively. Moreover, the claw ring can be installed and removed quickly and simply. The claw ring can be embodied integrally with an already existing part, such as the actuating sleeve, thus economizing on additional components. However, if the claw ring is formed by a separate component, then the claw ring and the actuating sleeve can advantageously be formed of a material appropriate for the function; specifically, the claw ring can be of metal while the actuating sleeve is of plastic.

In a further feature of the invention, it is proposed that the claws of the claw ring have at least in part a trapezoidal shape in cross section. A transmission area can be enlarged compared to claws with rectangular cross-sectional surfaces, and especially advantageously, high torques can be transmitted.

It is also proposed that the hammer barrel radially surrounds the tool receptacle in an overlapping region, as a result of which the tool receptacle can be supported rotatably in or by the hammer barrel in a structurally simple way and easily mounted and removed.

Advantageously, the hammer barrel and the tool receptacle are connected solidly to one another in at least one direction via the transmission unit. The hammer barrel and the tool receptacle can be fixed structurally simply with only a few components in the direction of rotation and/or in the axial direction to one another. If the hammer barrel and the tool receptacle are fixed to one another in the axial direction, the transmission unit can advantageously be used for switching over between an idle position and an operating position.

If at least one locking body is formed by a bolt, the hammer barrel and the tool receptacle can be joined structurally simply and economically to one another in a manner fixed against relative rotation, specifically via radial bores in the hammer barrel and in the tool receptacle. However, the connection between the hammer barrel and the tool receptacle can also be brought about by some other connecting body that appears suitable to one skilled in the art.

Especially advantageously, the bolt is braced radially inward on a percussion bolt. The bolt can be supported in continuous radial bores, which are economical to make.

Further advantages will become apparent from the ensuing drawing description. In the drawing, exemplary embodiments of the invention are shown. The drawing, description and claims include numerous characteristics in combination. One skilled in the art will expediently consider the characteristics individually as well and put them together to make useful further combinations.

DESCRIPTION OF THE PREFERRED EMBODIMENTS

Figure 1:
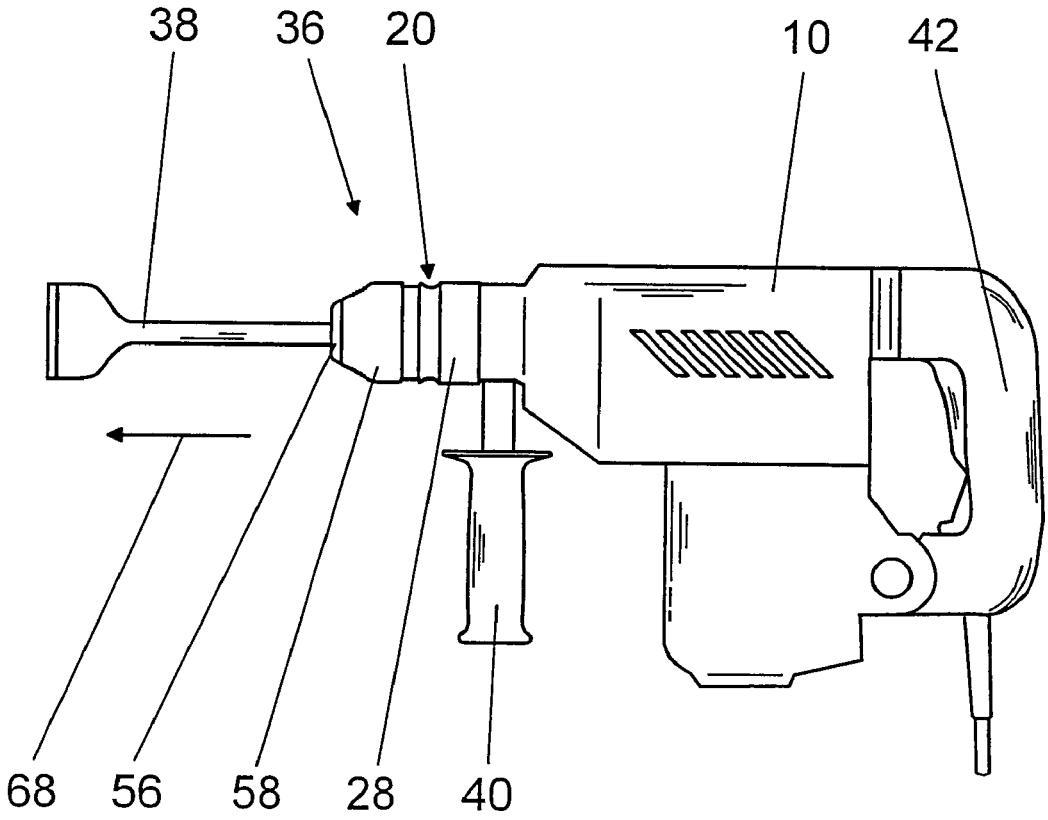
FIG. 1, a percussion hammer, shown schematically in a side view.

FIG. 1 shows a percussion hammer, with an electric motor, not identified by reference numeral, in a housing 10 and with a percussion mechanism, by way of which a flat chisel 38 fastened in a tool mount 36 can be driven in hammering fashion. A first handle 40, extending perpendicular to the actuating direction, is secured to the housing 10 on a side of the percussion hammer toward the tool mount 36. A second, hoop-shaped handle 42 extending perpendicular to the actuating direction is secured on the side of the housing 10 remote from the tool mount 36.

Figure 2:
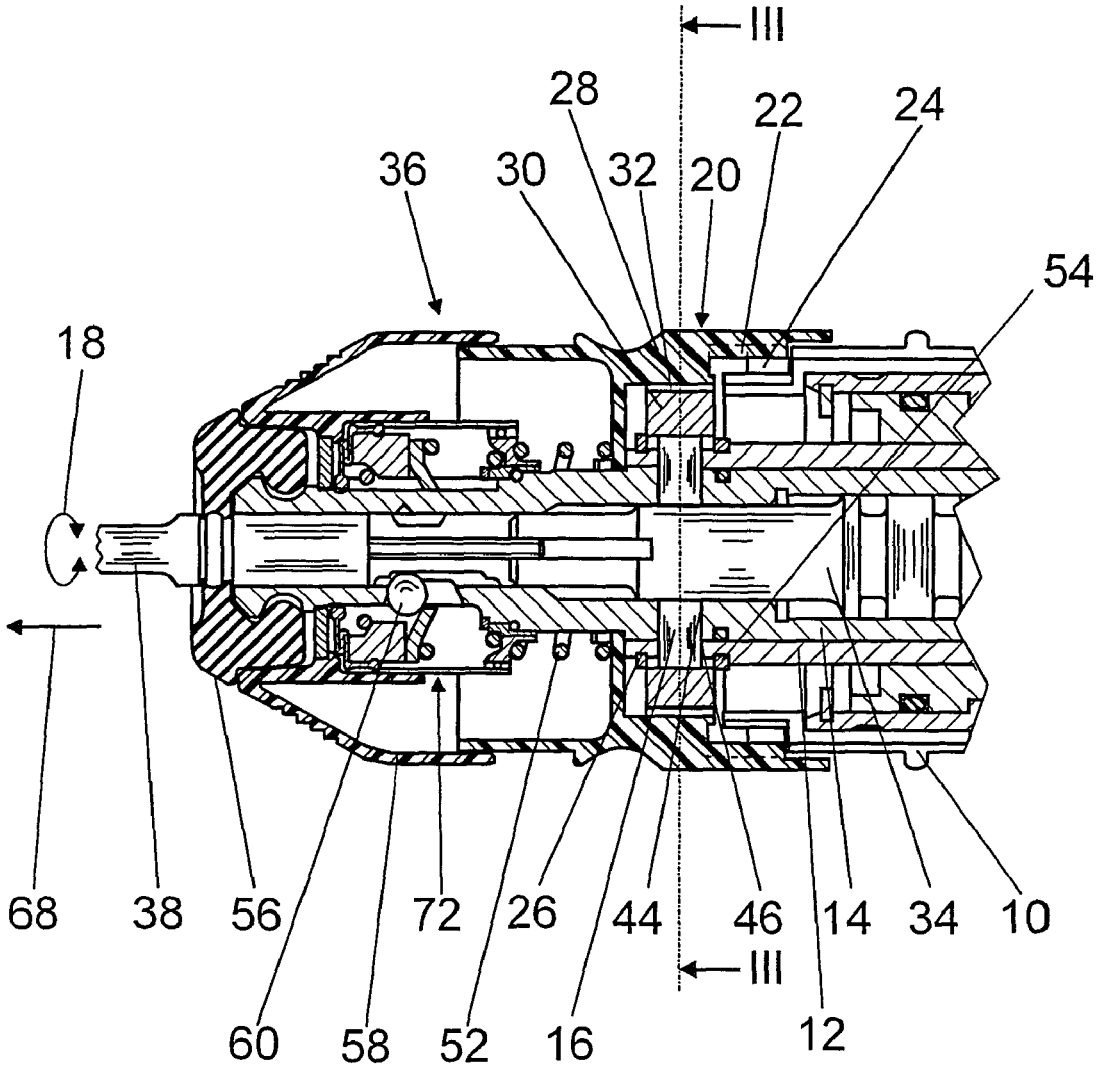
FIG. 2, an enlarged view of a tool receptacle of the percussion hammer of FIG. 1.
Figure 3:
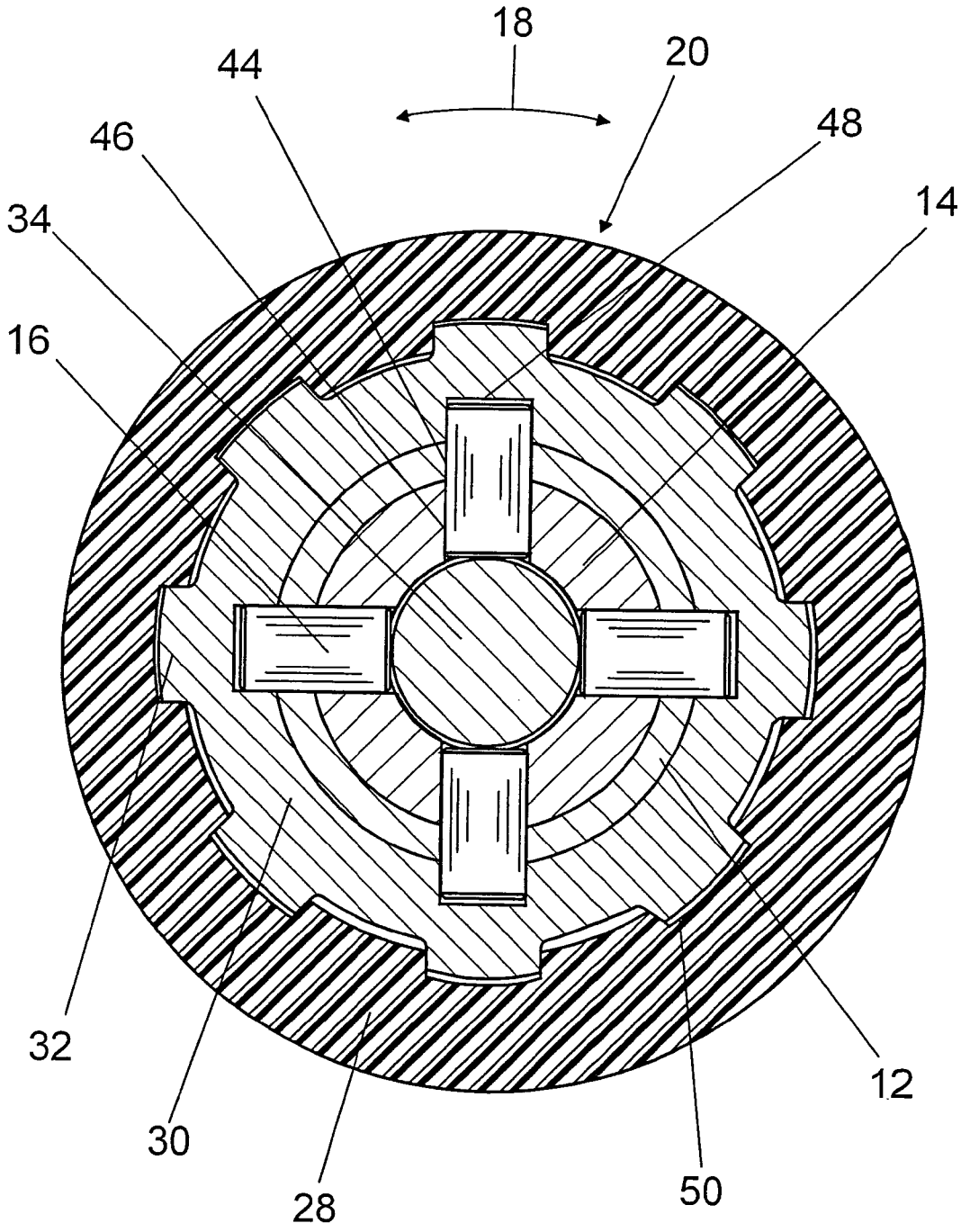
FIG. 3, an enlarged view of a section taken along the line III—III in FIG. 2.

The tool mount 36 has a tool receptacle 14, which is embodied separately from a hammer barrel 12 (FIG. 2 and FIG. 3). The hammer barrel 12, with its end pointing in the machining direction 68, radially surrounds the tool receptacle 14 in an overlapping region. In their overlapping region, the hammer barrel 12 and the tool receptacle 14 have four continuous radial bores 44, 46, which are distributed uniformly over their circumference. In the installed state, the radial bores 44, 46 are located one above the other and form a guide for locking bodies 16, embodied as bolts, which extend through the radial bores 44, 46 and are braced radially inward on a percussion bolt 34. The hammer barrel 12 is surrounded radially by a claw ring 30 of a transmission unit 20, which is fixed in the axial direction on the hammer barrel 12 via securing rings 26, 54 (FIG. 2). On its radially inner circumference, the claw ring 30 has four radial grooves 48, which are distributed uniformly over the inside circumference of the claw ring 30 and which in the installed state are located above the radial bores 44, 46. The four locking bodies 16 embodied as bolts engage the radial grooves 48 by positive engagement. The tool receptacle 14 and the hammer barrel 12 are solidly joined to one another in the direction of rotation 18 and in the axial direction via the locking bodies 16 embodied as bolts, and they are connected to the claw ring 30 in the direction of rotation 18 via the locking bodies 16.

On its radially outer circumference, the claw ring 30 has claws 32, which engage corresponding recesses 50 that are formed onto a radially inward-pointing circumference of an actuating sleeve 28 (FIG. 3). The tool receptacle 14 and the hammer barrel 12 are connected to the actuating sleeve 28 by positive engagement in the direction of rotation 18 via the claw ring 30.

A set of teeth 22 is formed onto the inside circumference of the actuating sleeve 28, on its end remote from the tool mount 36. Radially inward, by positive engagement, the set of teeth 22 engages a corresponding set of teeth 24, which is formed onto the outer circumference on an end of the housing 10 pointing toward the tool mount 36. Via the sets of teeth 22, 24, the actuating sleeve 28 is fixed in the direction of rotation 18 to the housing 22. The actuating sleeve 28 and the claw ring 30 form the transmission unit 20, by way of which the tool receptacle 14 can be fixed, with the locking bodies 16 embodied as bolts, in a plurality of rotary positions on the housing 10 radially outward in the direction of rotation 18.

If a user presses the actuating sleeve 28 in the machining direction 68 counter to a spring force of a spring element 52, the sets of teeth 22, 24 become disengaged. The recesses 50 in the actuating sleeve 28 and the claws 32 of the claw ring 30, which are movable toward one another in the axial direction, nevertheless remain in engagement with one another in the circumferential direction. The tool receptacle 14 is rotatable in the direction of rotation 18 via the transmission unit 20 and the locking bodies 16, or in other words via the actuating sleeve 28, the claw ring 30, and via the locking bodies 16. In the rotary motion, the hammer barrel 12 and the tool receptacle 14 are rotated jointly.

Once a desired rotary position of the flat chisel 38, which has been fixed against relative rotation in the tool receptacle 14, is reached, the user releases the actuating sleeve 28, and the spring element 52 presses the actuating sleeve 28 in the opposite direction from the machining direction 68. The sets of teeth 22, 24 enter into engagement with each other again, and the tool receptacle 14 is fixed in the direction of rotation 18 on the housing 10 via the transmission unit 20 and via the locking bodies 16.

For replacing the tool receptacle 14, the following components are first removed: a dust guard cap 56 and an actuating sleeve 58, which forms one part of the tool mount 36; a sealing unit 72; and locking bodies 60, which hold the flat chisel 38 in the tool receptacle 14 in a manner fixed against relative rotation but axially displaceably. The spring element 52 is now accessible and can be removed. Then, once the actuating sleeve 28 and the first securing ring 26 have been removed, the claw ring 30 can be pulled off in the machining direction 68, and the locking bodies 16 embodied as bolts can be removed. The tool receptacle 14 can then be taken off and replaced.

Once the tool receptacle 14 has been removed, the user can replace it together with the percussion bolt 34 and convert the percussion hammer to a new, alternative insertion system, without having to completely disassemble the percussion hammer.

Figure 4:
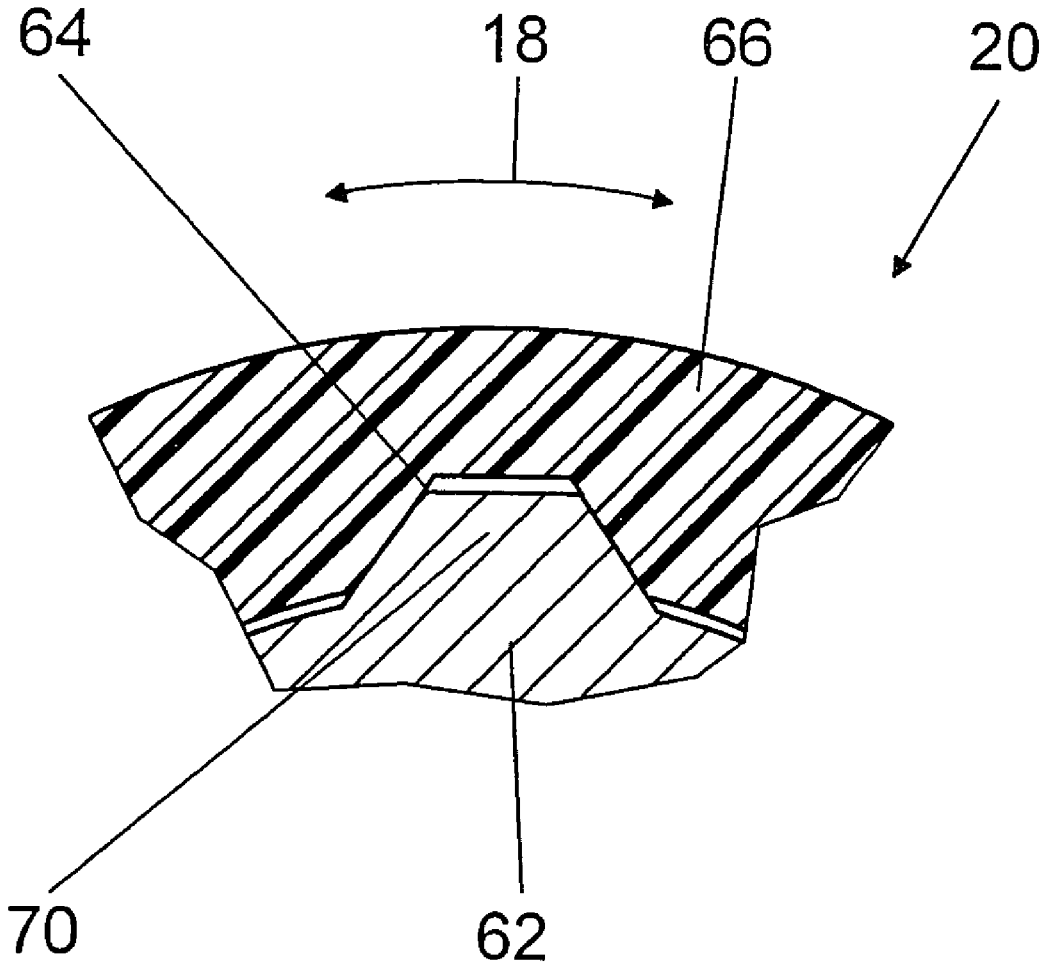
FIG. 4, a detail of an alternative claw ring and an alternative actuating sleeve.

In FIG. 4, an alternative claw ring 62 and an alternative actuating sleeve 66 are shown in fragmentary form. Components that remain essentially the same are all identified by the same reference numerals as before. Moreover, for characteristics and functions that remain the same, one can refer to the description of the exemplary embodiment in FIGS. 1–3. The description below is limited essentially to the differences from the exemplary embodiment of FIG. 3.

FIG. 4 shows an enlarged view of a claw 70 of the claw ring 62. In its cross section, the claw 70 has a trapezoidal shape, which by positive engagement engages a corresponding trapezoidal recess 64 in the actuating sleeve 66.

List of Reference Numerals

| | |
|---|---|
| 10 | Housing |
| 12 | Hammer barrel |
| 14 | Tool receptacle |
| 16 | Locking body |
| 18 | Direction of rotation |
| 20 | Transmission unit |
| 22 | Set of teeth |
| 24 | Set of teeth |
| 26 | Securing ring |
| 28 | Actuating sleeve |
| 30 | Claw ring |
| 32 | Claw |
| 34 | Percussion bolt |
| 36 | Tool mount |
| 38 | Flat chisel |
| 40 | Handle |
| 42 | Handle |
| 44 | Radial bore |
| 46 | Radial bore |
| 48 | Radial groove |
| 50 | Recess |
| 52 | Spring |
| 54 | Securing ring |
| 56 | Dust guard cap |
| 58 | Actuating sleeve |
| 60 | Locking body |
| 62 | Claw ring |
| 64 | Recess |
| 66 | Actuating sleeve |
| 68 | Machining direction |
| 70 | Claw |
| 72 | Sealing unit |

The invention claimed is:

1. A hand power tool, comprising a housing (10), a hammer barrel (12), a tool receptacle (14) that is separated from the hammer barrel (12), at least one locking body (16) for fixing the tool receptacle (14) in a direction of rotation (18), a transmission unit (20) arranged radially outwardly of the tool receptacle (14) for transmitting a torque from the tool receptacle (14) radially outwardly and fixing the tool receptacle (14) in the direction of rotation (18) of the tool receptacle (14) on the housing (10),one part of the transmission unit (20) being formed by an actuating sleeve (28), the transmission unit (20) having a claw ring (30) which is separate from the actuating sleeve (28) and the tool receptacle (14) being connected through the claw ring (30) with the actuating sleeve (28) in the direction of rotation (18).

2. The hand power tool of claim 1, characterized in mat the tool receptacle (14) is fixable in at least two rotary positions.

3. The hand power tool of claim 1, characterized in that the transmission unit (20) is braced in the direction of rotation (18) clockwise and counterclockwise via at least one set of teeth (22, 24) on the housing (10).

4. The hand power tool of claim 3, characterized in that the set of teeth (22), by way of which the tool receptacle (14) is fixable on the housing (10) with the corresponding set of teeth (24), is formed onto the actuating sleeve (28).

5. The hand power tool of claim 1, characterized in that the claws (70) of the claw ring (62) have at least in part a trapezoidal shape in cross section.

6. The hand power tool of foregoing claim 1, characterized in that the hammer barrel (12) radially surrounds the tool receptacle (14) in an overlapping region.

7. The hand power tool of claim 1, characterized in that the hammer barrel (12) and the tool receptacle (14) are connected solidly to one another in at least one direction via the transmission unit (20).

8. The hand power tool of claim 7, characterized in that at least one locking body (16) is fanned by a bolt.

9. The hand power tool of claim 8, characterized in that the locking body (16) embodied as a bolt is braced radially inward on a percussion bolt (34). Image Page 4 A hand power tool has a housing (10), a hammer barrel (12), a tool receptacle (14) that is separated from the hammer barrel 012) at least one locking body (16) for fixing the tool receptacle (14) in a direction of rotation (18), a transmission unit (20) arranged radially outwardly of the tool receptacle (14) for transmitting a torque from the tool receptacle (14) radially outwardly and fixing the tool receptacle (14) in the direction of rotation (18) of the tool receptacle (14) on the housing (10), one part of the transmission unit (20) being formed by an actuating sleeve (28), the transmission unit (20) having a claw ring (30) which is separate from the actuating sleeve (28) and the tool receptacle (14) being connected through the claw ring (30) with the actuating sleeve (28) in the direction of rotation (18).

* * * * *